US009177441B2

(12) United States Patent
Jaffe

(10) Patent No.: US 9,177,441 B2
(45) Date of Patent: Nov. 3, 2015

(54) WAGERING GAME WITH COLOR-COORDINATED PROGRESSIVE AWARD INDICATORS

(75) Inventor: Joel R. Jaffe, Glenview, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 1702 days.

(21) Appl. No.: 12/514,234

(22) PCT Filed: Nov. 5, 2007

(86) PCT No.: PCT/US2007/023263

§ 371 (c)(1),
(2), (4) Date: May 8, 2009

(87) PCT Pub. No.: WO2008/063394

PCT Pub. Date: May 29, 2008

(65) Prior Publication Data

US 2010/0048284 A1 Feb. 25, 2010

Related U.S. Application Data

(60) Provisional application No. 60/857,981, filed on Nov. 9, 2006.

(51) Int. Cl.
*A63F 9/24* (2006.01)
*G07F 17/32* (2006.01)

(52) U.S. Cl.
CPC ..... *G07F 17/3258* (2013.01); *G07F 17/3211* (2013.01)

(58) Field of Classification Search
CPC ..... G07F 17/3258; G07F 17/3211
USPC ..... 463/16–25
See application file for complete search history.

(56) References Cited

U.S. PATENT DOCUMENTS

| | | | | |
|---|---|---|---|---|
| 6,056,642 | A | 5/2000 | Bennett | |
| 6,517,433 | B2 | 2/2003 | Loose et al. | |
| 2001/0023201 | A1 * | 9/2001 | Takatsuka et al. | 463/31 |
| 2002/0025847 | A1 * | 2/2002 | Thomas et al. | 463/20 |
| 2004/0072607 | A1 * | 4/2004 | Thomas et al. | 463/16 |
| 2004/0198485 | A1 | 10/2004 | Loose et al. | |
| 2005/0014548 | A1 * | 1/2005 | Thomas | 463/16 |
| 2005/0054423 | A1 * | 3/2005 | Wadleigh | 463/20 |
| 2005/0059476 | A1 * | 3/2005 | Vancura | 463/20 |
| 2006/0068892 | A1 * | 3/2006 | Gomez et al. | 463/20 |
| 2007/0281784 | A1 * | 12/2007 | Seelig et al. | 463/26 |

OTHER PUBLICATIONS

International Search Report PCT/US2007/023263, dated May 9, 2008.

* cited by examiner

*Primary Examiner* — Vongsavanh Sengdara
(74) *Attorney, Agent, or Firm* — Nixon Peabody LLP

(57) ABSTRACT

A gaming machine for conducting wagering games comprises a plurality of reels, each reel having one or more reel symbols with a colored background and one or more reel symbols with a white background. The gaming machine may include a progressive game having multiple progressive jackpots that are awarded based on patterns formed by the reel symbols with the colored background in the outcomes of the wagering game. In some embodiments, a video display device is provided for overlaying a video image on the reels. The video image operates as a colored placeholder to hold any partial patterns that were formed by the reel symbols having the colored background for multiple plays of the wagering game. Reel symbols having the colored background appearing in subsequent outcomes of the wagering game may then be used to complete one or more patterns.

25 Claims, 10 Drawing Sheets

WAGERING GAME WITH COLOR-COORDINATED PROGRESSIVE AWARD INDICATORS

CROSS REFERENCE TO RELATED APPLICATIONS

This application is a U.S. National stage of International Application No. PCT/US2007/023263, filed Nov. 5, 2007, which is related to and claims priority to U.S. Provisional Application No. 60/857,981 filed Nov. 9, 2006, which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a wagering game having a color-based progressive game.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines.

Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Another way to increase the entertainment value of a game is to enhance the display of the gaming machines. For gaming machines with video displays, improvements in video technology have enabled the display of richer and more colorful graphics. For gaming machines with mechanical displays, however, the enhancements early on were less technologically advanced. For example, some mechanical reel symbols were colored by backlighting the mechanical symbols with colored lighting elements. Sometimes the reel itself might contain electroluminescent elements that defined one or more reel symbols. To display a symbol in multiple colors or formats using such an arrangement, multiple electroluminescent elements were needed for the symbol.

Recent advances in transmissive display technology have made it possible to more easily modify the appearance of mechanical displays. A transmissive display is essentially a transparent video display that is superimposed over the mechanical display. The transmissive display may then be operated to display selected video images over the mechanical display. These video images may include translucent portions such that the underlying mechanical display is visible, but in an altered state (i.e., different color, texture, etc.). The video images may also include opaque portions so as to completely block out parts of the underlying mechanical display.

Transmissive display technology gives wagering game designers the capability and flexibility to more easily design and modify the appearance of mechanical displays. Accordingly, there is a need to develop new and improved wagering games for mechanical displays using this technology, with features that take full advantage of the capabilities of the transmissive display to thereby enhance the entertainment value of the wagering games.

SUMMARY OF THE INVENTION

According to one aspect of the present invention, a gaming machine for conducting a wagering game includes a wager input device for receiving a wager input at the gaming machine and a game display operable to display an outcome of a wagering game conducted on the gaming machine. The outcome is randomly selected from a plurality of outcomes that are represented by a plurality of game symbols. The game symbols include game symbols having a first color background and game symbols having a second color background. In response to one or more of the game symbols having the first color background forming a predefined pattern in the outcome of the wagering game, a special event is awarded to a player at the gaming machine.

According to another aspect of the invention, a method of conducting a wagering game on a gaming machine comprises displaying an outcome of the wagering game on a display of the gaming machine, the outcome being randomly selected from a plurality of outcomes. Each outcome is represented by a plurality of game symbols, including game symbols having a first color background and game symbols having a second color background. The method further comprises overlaying a video image on the display, the video image including colored placeholders positioned over those game symbols having the first color background appearing in the outcome of the wagering game. The method finally comprises awarding a special event if an outcome of a subsequent play of the wagering game includes a special event pattern defined by the colored placeholders and one or more game symbols having the first color background appearing in the outcome of the subsequent play of the wagering game.

According to still another aspect of the invention, a method of conducting a wagering game on a gaming machine comprises receiving a wager input from a player at the gaming machine and displaying an outcome of the wagering game on a display of the gaming machine. The outcome is randomly selected from a plurality of outcomes, the plurality of outcomes being represented by a plurality of game symbols, including special event game symbols. The method further comprises awarding a first special event to the player in response to one or more special event game symbols forming a first pattern of color in the outcome of the wagering game, and awarding a second special event to the player in response to one or more special event game symbols forming a second pattern of color in a subsequent outcome of the wagering game.

According to yet another aspect of the invention, a method of conducting a wagering game on a gaming machine comprises receiving a wager input from a player at the gaming machine and displaying an outcome of the wagering game on a display of the gaming machine. The outcome is randomly selected from a plurality of outcomes, the plurality of outcomes being represented by a plurality of game symbols, including special event game symbols. The method further comprises awarding a special event to the player in response to one or more special event game symbols forming a first predefined pattern in the outcome of the wagering game. Each special event game symbol forming the predefined pattern includes a special event indicator thereon for dynamically displaying information related to the special event on the special event game symbol.

According to yet another aspect of the invention, a computer readable storage medium is encoded with instructions for directing a gaming system to perform one or more of the above methods.

Additional aspects of the invention will be apparent to those of ordinary skill in the art in view of the detailed description of various embodiments, which is made with reference to the drawings, a brief description of which is provided below.

Figure 1:
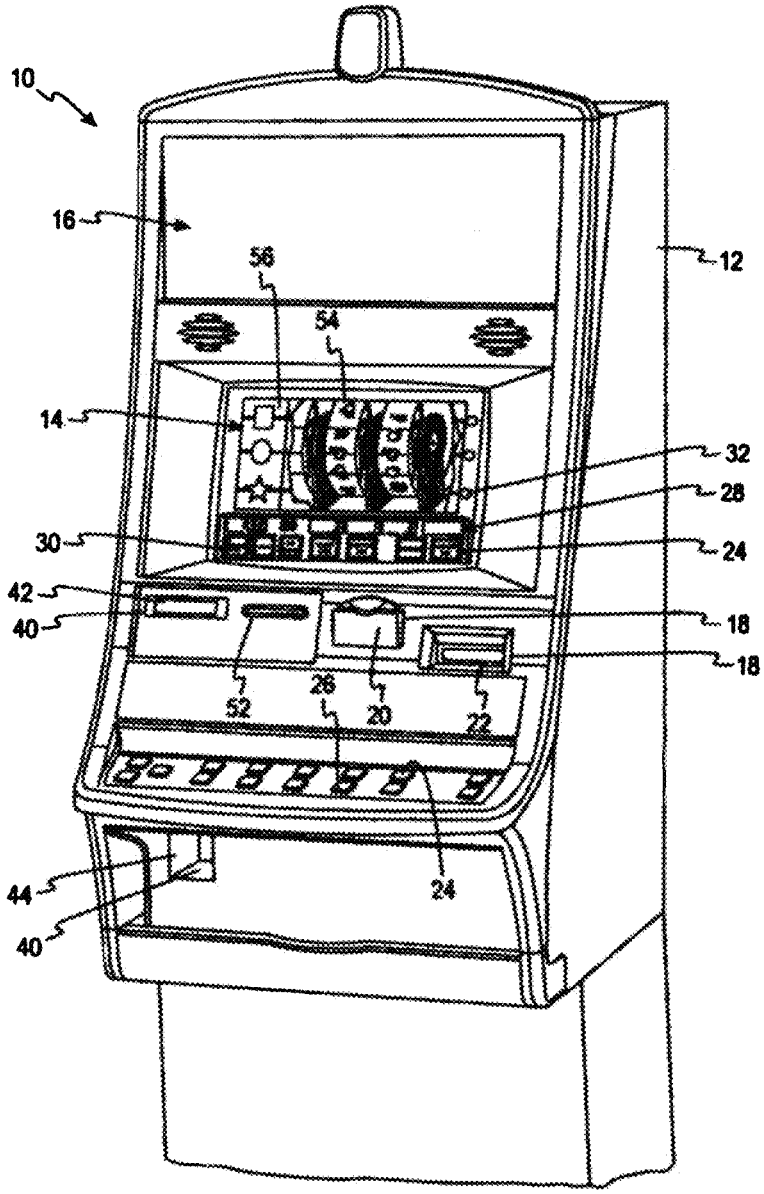
FIG. 1 is a perspective view of an exemplary gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail various embodiments of the invention with the understanding that the present disclosure is to be considered as an exemplification of the principles of the invention and is not intended to limit the broad aspect of the invention to the embodiments illustrated.

Referring to FIG. 1, a mechanical reel gaming machine 10 similar to those used in gaming establishments, such as casinos, is shown. The gaming machine 10 comprises a housing 12 and a number of input devices, including a value input device 18 and a player input device 24. For outputs, the gaming machine 10 comprises a primary display area 14 for displaying information about base wagering games and a secondary display area 16 for displaying game events, game outcomes, and/or signage information. The primary display area 14 and/or secondary display area 16 may also display information about bonus wagering games and progressive wagering games. In accordance with embodiments of the invention, the primary display area 14 comprises a plurality of mechanical reels 54 and a transmissive display 56 superimposed over the mechanical reels 54. Each of the foregoing components is described in more detail below. While the exemplary embodiments described below refer to the mechanical reels 54, in other embodiments the mechanical reels 54 can be replaced with video reels 54' (see FIG. 3). Thus, alternatively, the primary display area 14 can include the transmissive display 56 being superimposed over a plurality of video reels 54.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency. Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like on the primary display area 14 (over the transmissive display 56) and/or on secondary display area 16. The touch screen 28 contains soft touch keys 30 denoted by graphics on the underlying primary display area 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

A player begins play of the base wagering game by making a wager via the value input device 18 of the gaming machine 10. A player can select play by using the player input device 24, via the buttons 26 or the touch screen keys 30. The base game consists of a plurality of symbols arranged in an array, and includes at least one payline 32 that indicates one or more outcomes of the base game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display area 16 or other dedicated player-tracking display for providing the player with information about his or her account or other player-specific information. Also, in some embodiments, the information reader 52 may be used to restore game assets that the player achieved and saved during a previous game session.

In the illustrated embodiment, the gaming machine 10 is an "upright" version in which the primary display area 14 is oriented vertically relative to the player. Alternatively, the gaming machine may be a "slant-top" version in which the primary display area 14 is slanted at about a thirty-degree angle toward the player of the gaming machine 10. Furthermore, although only three mechanical reels are shown in the primary display area 14, those having ordinary skill in the art will recognize that the gaming machine 10 may comprise fewer or more mechanical reels (e.g., four reels, five reels, etc.), depending on the particular configuration of the primary display area 14.

Figure 2A:
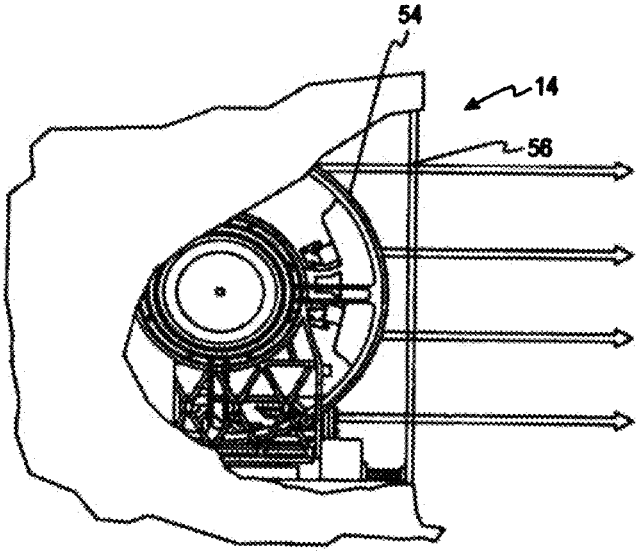
FIGS. 2*a*-2*b* are cross-sectional side views of an exemplary display area embodying the present invention.
Figure 2B:
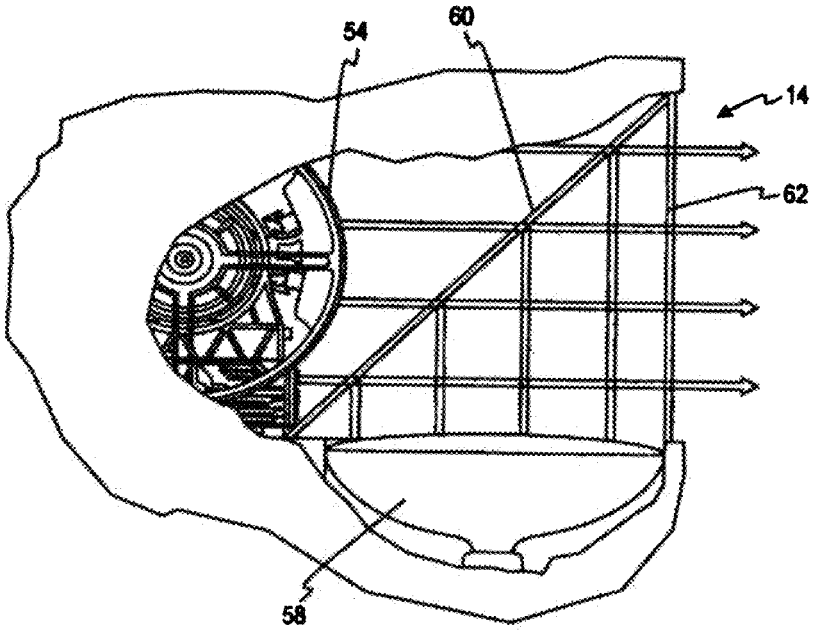

FIGS. 2*a*-2*b* illustrate exemplary implementations of the primary display area 14 in which a video image is superimposed over the mechanical reels 54. Although not expressly labeled, each reel of the mechanical reels 54 has a plurality of reel symbols (see FIG. 1) that represent a randomly-selected outcome of the wagering game. The video image may then be positioned over the mechanical reels 54 to enhance and/or alter the appearance (e.g., color, texture, etc.) of the mechanical reels 54. There are at least two possible configurations for the primary display area 14: a direct image configuration (FIG. 2*a*), and a virtual image configuration (FIG. 2*b*). These configurations are described below.

Referring to FIG. 2*a*, in the direct image configuration, a transmissive display 56 is positioned directly in front of the mechanical reels 54 and generates a direct image. In such an arrangement, the transmissive display 56 may be a flat panel transmissive video display, for example, a transmissive liquid crystal display (LCD) commercially available from LG Phillips LCD Co., Ltd., of Seoul, Korea, Sharp Electronics Corp. of Tokyo, Japan, and other display manufacturers. The flat panel transmissive video display is preferably preconfigured with the touch screen 28 (see FIG. 1) mounted to a front surface of the display.

In the virtual image configuration, shown in FIG. 2*b*, a reflected video image is used instead of a direct image. In such an arrangement, the reflected video image may be generated by, for example, a standard video display 58 and a partially reflective mirror 60. The standard video display 58 may be mounted below the mechanical reels 54 and substantially normal thereto, and the partially reflective mirror 60 may be positioned over the mechanical reels 54 at a predetermined angle (e.g., 45 degrees). Video images from the standard video display 58 are then reflected off the partially reflective mirror 60 so that they appear to a player to be superimposed over the mechanical reels 54. The video projection display 58 may be any suitable video projection display known to those having ordinary skill in the art, including a CRT, LCD, dot matrix, LED, electro luminescent, and the like. In some embodiments, the primary display area 14 further comprises a transparent glass cover/window 62 positioned over the partially reflective mirror 60 to protect the mirror 60. Such a cover/window 62 may be optionally configured with the touch screen 28 for receiving player input.

The superimposed video images may be selectively made transparent, semi-transparent (i.e., translucent), or opaque in selected places. This allows preselected images to be displayed over certain portions of the primary display area 14, with the result that certain areas of the primary display area 14 are either altered in some way (e.g., highlighted, colored, etc.), or completely blocked by the superimposed images. All video images superimposed on the primary display area 14 may be rendered in two-dimensional (e.g., using Flash Macromedia™) or three-dimensional graphics (e.g., using Renderware™). The images may be played back (e.g., from a recording stored on the gaming machine 10), streamed (e.g., from the gaming network), or received as a TV signal (e.g., either broadcast or via cable). The images may be animated, or they may be real-life images, either prerecorded (e.g., in the case of marketing/promotional material) or as live footage, and the format of the video images may be an analog format, a standard digital format, or a high-definition (HD) digital format. Using superimposed video images in this way allows numerous types of improvements and enhancements to be made to the appearance of the primary display area 14 in real time and during on-going game play.

For information regarding the use of video overlay technology in gaming machines and for embodiments employing video overlay displays, the reader is referred to commonly assigned U.S. Published Application No. 20040198485, titled "Gaming Machine with Superimposed Display Image," filed on Nov. 7, 2003, and also to commonly-assigned U.S. Pat. No. 6,517,433, titled "Reel Spinning slot Machine With Superimposed Video Image," issued on Feb. 11, 2003, each of which is incorporated herein by reference in its entirety.

Figure 3:
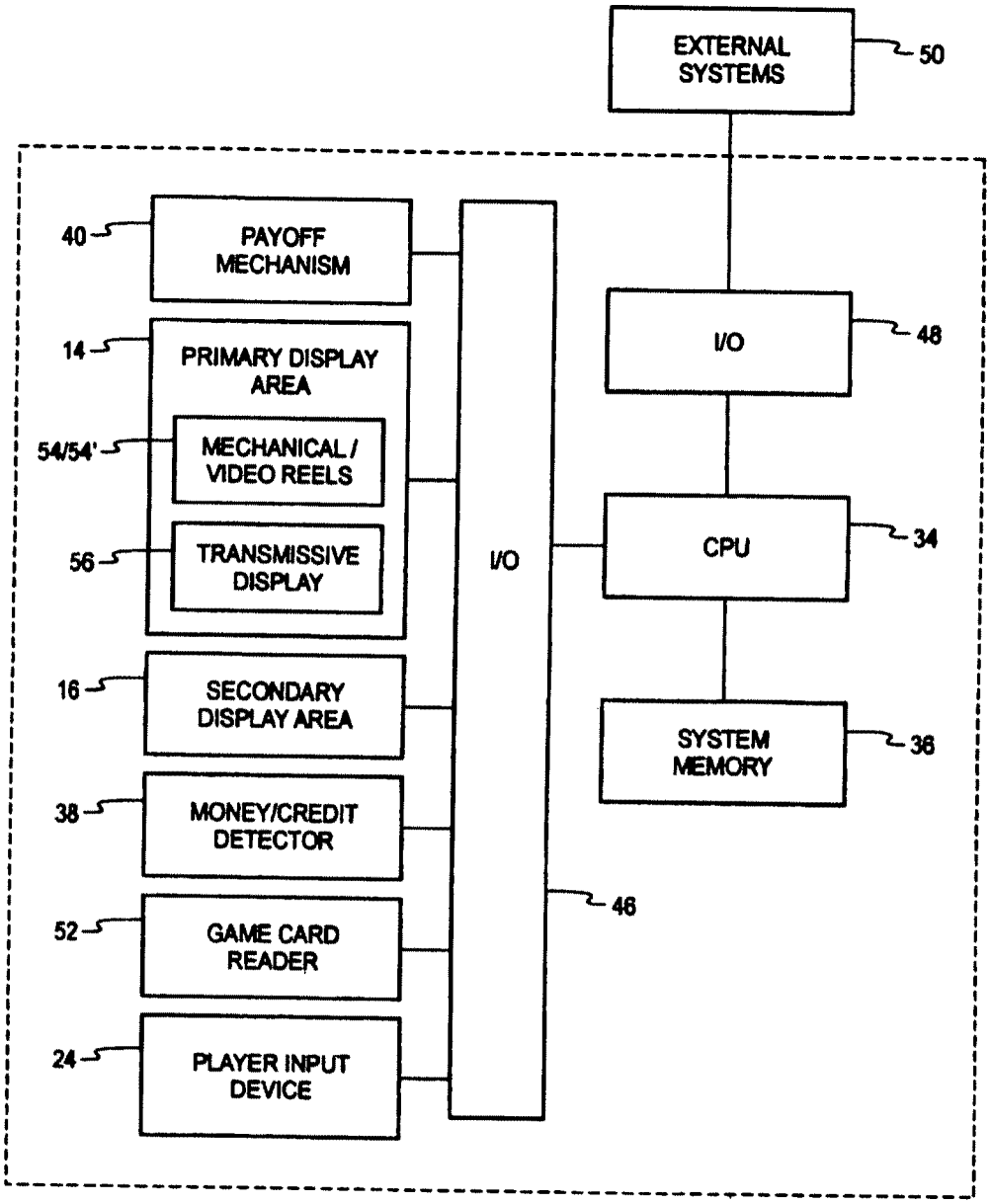
FIG. 3 is a block diagram of an exemplary control system suitable for operating the gaming machine of FIG. 1.

Turning now to FIG. 3, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10, but may be located outboard of the housing 12 and connected to the remainder of the components of the gaming machine 10 via a variety of different wired or wireless connection methods.

As seen in FIG. 3, the controller 34 is also connected to, and controls, the primary display area 14, the player input device 24, and a payoff mechanism 40. The primary display area 14 in this embodiment uses the transmissive display 56 to superimpose a video image over the mechanical/video reels 54/54', but a reflected image arrangement (see FIG. 2*b*) may also be used in other embodiments. The payoff mechanism 40 is operable in response to instructions from the controller 34 to award a payoff to the player in response to certain winning outcomes that might occur in the base game or the bonus game(s). The payoff may be provided in the form of points, bills, tickets, coupons, cards, and the like. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, and the like. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 3, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10.

By virtue of the superimposed video images, a variety of traditional as well as visually-enhanced wagering games involving the mechanical reels 54 may be played on the gaming machine 10. These wagering games may be provided to the gaming machine 10 using any suitable means known to those having ordinary skill in the art, including hardware upgrades as well as direct downloads via external systems 50. In the latter case, the gaming machine 10 may communicate with the external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. Numerous alternative configurations are possible such that the aforementioned and other functions may be performed onboard or external to the gaming machine 10 as may be necessary for particular applications.

Thus far, embodiments of the invention have only been described as video images being superimposed on the primary display area 14. It is also possible, however, to superimpose the video images on the secondary display area 16 as well without departing from the scope of the invention. Still, in most embodiments, the primary display area 14 is the one with the video images superimposed thereon. The reason for this is because in most gaming machines 10, the primary display area 14 is the one that includes the mechanical reels (e.g., for a slot machine), a mechanical wheel (e.g., a roulette game), one or more dice, a pachinko board, or other board game. In alternative embodiments, however, the primary display area 14 may include video reels 54' by using a video display such as a CRT or LCD. Video images may then be superimposed on the video reels 54' as needed. In further alternative embodiments, the primary display area 14 may include a diorama presenting a three-dimensional model of a game environment. The diorama may be stationary in some implementations, or it may slide or move around in one or more dimensions.

Figure 4:
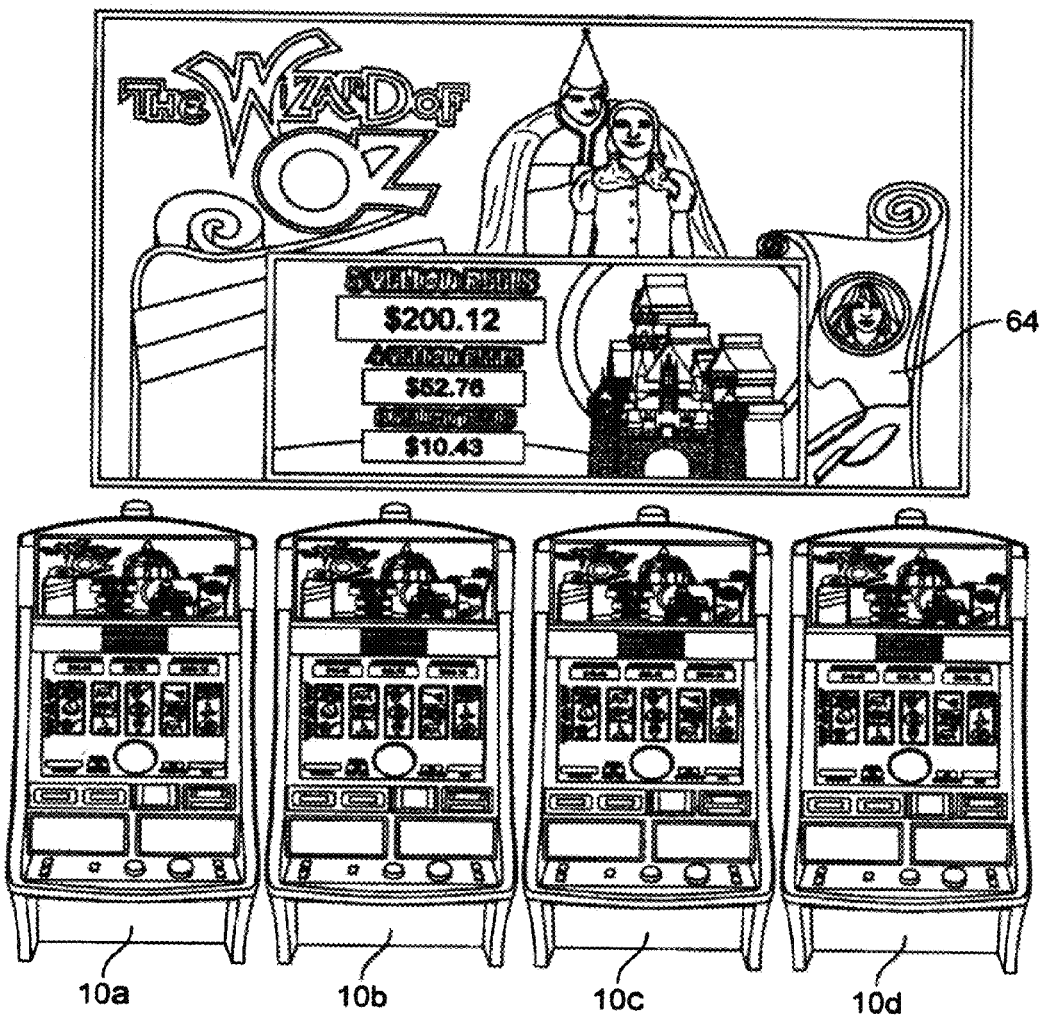
FIG. 4 is an exemplary bank of gaming machines embodying the present invention.

The foregoing video overlay technology allows wagering game designers to modify and enhance the appearance of the existing wagering games as well as to develop entirely new wagering games. FIGS. 4 and 5-8 illustrate an instance of how the video overlay technology may be used, for example, to implement a wagering game involving a progressive jackpot. The progressive jackpot, as explained above, is an award that is funded at least in part by a percentage of coin-in from the gaming machine or a plurality of participating gaming machines. The latter arrangement is shown in FIG. 4, where a plurality of participating gaming machines 10*a*, 10*b*, 10*c*, and 10*d* is linked together, for example, via the external systems 50 (see FIG. 1). Typically, the gaming machines 10*a-d* are located next to each other so that players and passersby may see the gaming machines 10*a-d* participating in the progressive jackpot, but it is possible for the gaming machines 10*a-d* to be spread out across the casino floor and/or over multiple casinos (e.g., a wide-area progressive). Signage 64 is provided for displaying various information (e.g., current jackpot amounts) about the progressive jackpot and may be positioned directly over the gaming machines 10*a-d* for ease of viewing.

Figure 5:
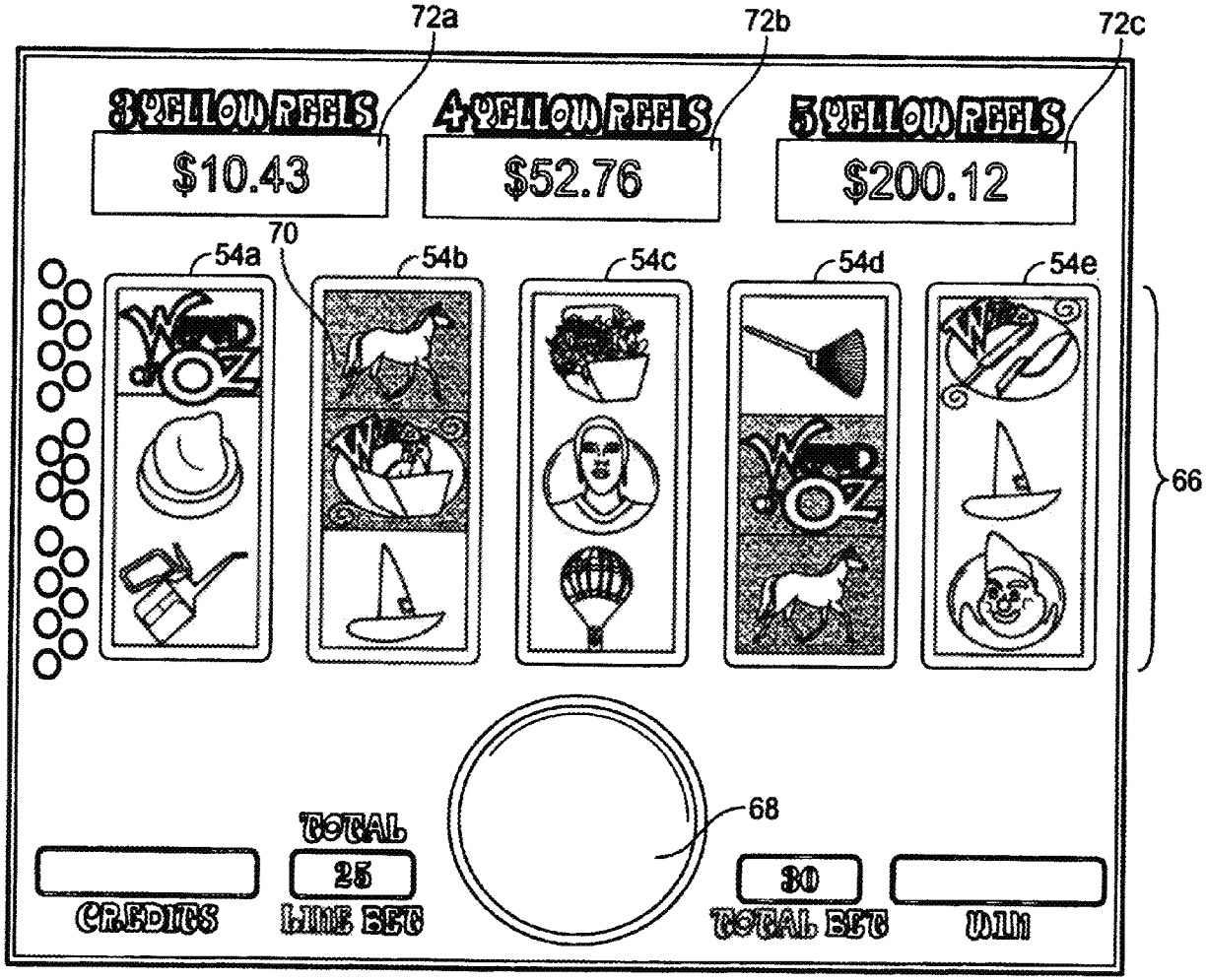
FIGS. 5-8 illustrate an exemplary wagering game embodying the present invention.

FIG. 5 illustrates an exemplary wagering game involving a progressive jackpot that may be conducted on one of the gaming machines 10*a-d* of FIG. 4. The wagering game of FIG. 5 may be a base wagering game or a bonus wagering game, and it may be displayed on the primary display area 14 or the secondary display area 16. In the example shown, the wagering game is a slot machine game having five reels 54*a*, 54*b*, 54*c*, 54*d*, and 54*e*, each reel 54*a-e* having a plurality of reel symbols 66. Only three of the reel symbols 66 for each reel 54*a-e* are visible to players in this embodiment, resulting in a 5×3 array of reel symbols 66. The reels 54*a-e* (and reel symbols 66) shown here are preferably mechanical reels, but video reels may also be used without departing from the scope of the invention. To play the wagering game, a player simply places a wager and presses an appropriate button, for example, a touch screen start button 68.

In FIG. 5, some of the reel symbols 66 are special in that they may have a different background from other ones of the reel symbols 66. The term "background" as used herein refers to the area within each reel symbol 66 that surrounds the reel symbol's icon or image. This icon or image (e.g., Dorothy, witch's hat, oil can, etc.) is traditionally used to determine whether an outcome is a winning outcome or a non-winning outcome. In accordance with embodiments of the invention, some reel symbols 66 may have a colored background, whereas other reel symbols 66 may have a white (or no color) background. One of the reel symbols having the colored background is identified by reference number 70 in FIG. 5. The background of these reel symbols 70 may then be used instead of, or in addition to, their icons or images to determine the outcomes of the wagering games.

In some embodiments, the wagering games that make use of the colored background of the reel symbols 70 are bonus wagering games, such as progressive games. Base wagering games, on the other hand, may continue to be determined using only the icons or images from the reel symbols 66, including those reel symbols 70 having the colored background. In this regard, the reel symbols 70 may be thought of as special-event indicators and may be used to initiate bonus games, progressive games, community games, or any other secondary gaming event. Any color may be used for the background color of the reel symbols 70 (e.g., yellow, red, blue, green, etc.), but in one embodiment, the color used is based on the theme of the wagering game. For example, in a wagering game having a "WIZARD OF OZ®" movie theme (as shown here), the background may be yellow in keeping with the famous "yellow brick road" in the movie.

To win a progressive jackpot, in some embodiments, the player must achieve an outcome that includes one of several predefined patterns of reel symbols 70 having the colored background. The predefined patterns of colored background contained in the progressive jackpot-winning outcomes may include, for example, reel symbols 70 having the colored background filling a certain number of reels 54*a-e* or scattered among the reels 54*a-e*, three or more reel symbols 70 having the colored background appearing in a predetermined payline, and the like. It is also possible, of course, to use a specific reel symbol location instead of patterns to define a progressive jackpot-winning outcome without departing from the scope of the invention.

In some embodiments, there may be multiple levels of progressive jackpots, each level requiring a different progressive jackpot-winning outcome. In FIG. 5, for example, there are three levels of progressive jackpots and three corresponding progressive jackpot-winning outcomes. Each progressive jackpot-winning outcome may require a different pattern of reel symbols 70 having a colored background. For example, reel symbols 70 having a colored background filling three reels 54*a-e* may award a first progressive jackpot, whereas reel symbols 70 having a colored background filling four reels 54*a-e* may award a second progressive jackpot, and reel symbols 70 having a colored background filling five reels 54*a-e* may award a third progressive jackpot, and so forth. These different progressive jackpots may be viewed and tracked via one or more progressive jackpot indicators 72*a*, 72*b*, and 72*c* that display the real-time amounts (e.g., $10.43, $52.76, and $200.12) associated with each progressive jackpot. Other predefined patterns may also be used without departing from the scope of the invention, such as one or more predetermined paylines, one or more predetermined reel symbol positions, and the like.

The selection of which particular reel symbols 70 to carry the colored background may be random, or it may follow some predetermined selection requirement, or both. In general, there should be more than enough reel symbols 70 having the colored background to form each predefined pattern, and they should be arranged on the reels 54*a-b* so that there is a finite probability of forming every predefined pattern. For example, in a 5×3 array where one of the predefined patterns requires an entire reel to be filled with reel symbols 70 having the colored background, there should be at least one sequence of three or more consecutive reel symbols 70 having the colored background in at least one reel 54*a-e*. If the array is a 5×5 array, then there should be at least one sequence of five or more consecutive reel symbols 70 having the colored background in at least one reel 54*a-b*. In embodiments where one of the predefined patterns requires multiple reels (e.g., three reels) to be filled with reel symbols 70, at least that number of reels (e.g., three) includes a winning sequence of consecutive reel symbols 70.

In FIG. 5, the outcome of the wagering game does not contain any reels 54*a-e* that are completely filled with reel symbols 70 having a colored background. Instead, only the top and middle reel symbols 70 of the second reel 54*b*, and the middle and bottom reel symbols 70 of the fourth reel 54*d* have the colored background. Unfortunately, the pattern formed by these reel symbols 70 having the colored background does not constitute one of the progressive jackpot-winning outcomes and, thus, no progressive jackpot is awarded for this wagering-game outcome.

Figure 6:
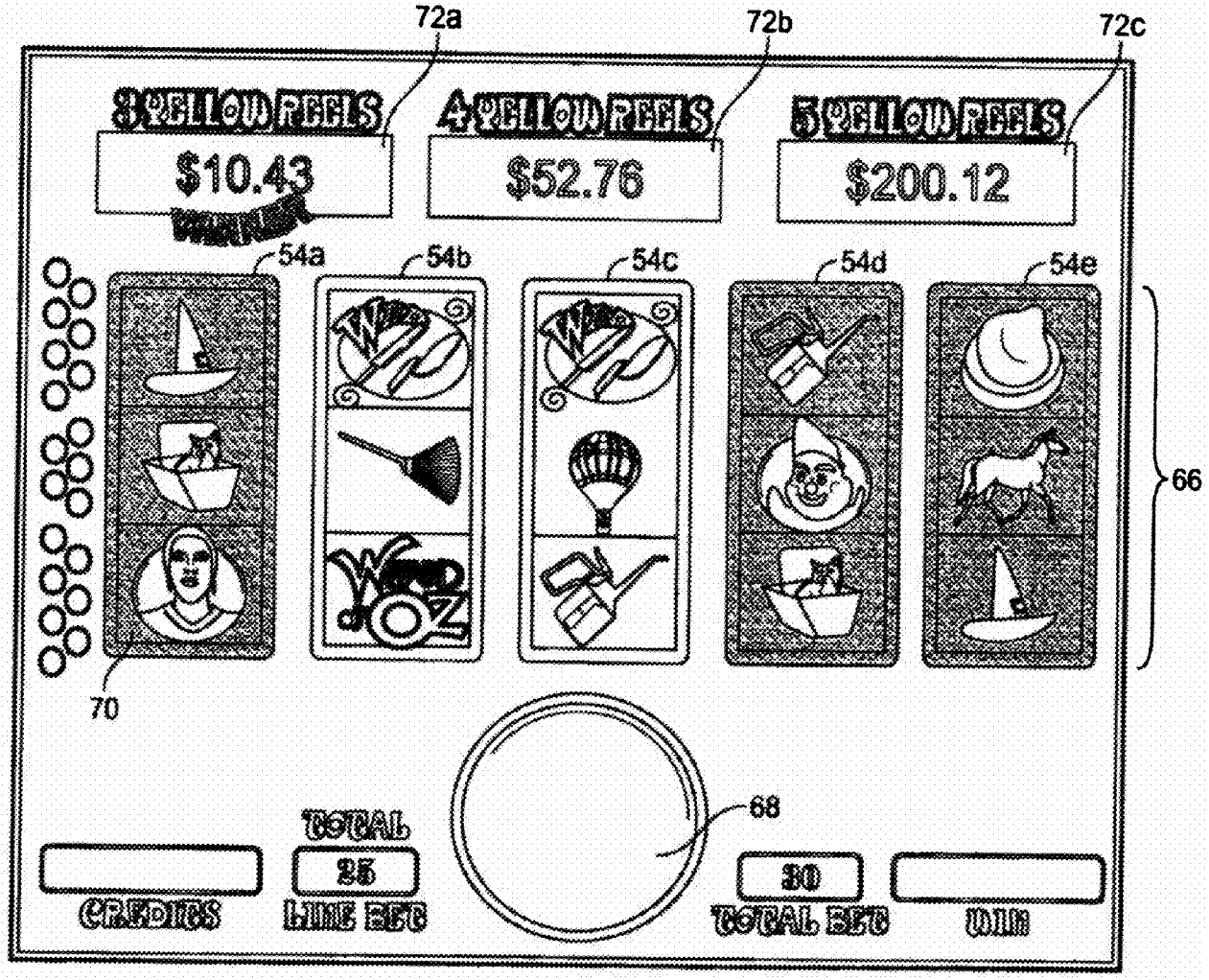

FIG. 6, on the other hand, does show a wagering-game outcome in which a progressive jackpot is awarded. In FIG. 6, at least three of the reels 54*a-e* are completely filled with reel symbols 70 having the colored background. In particular, the first reel 54*a*, fourth reel 54*d*, and fifth reel 54*e* are all filled with reel symbols 70 having the colored background. This pattern of reel symbols 70 constitutes one of the progressive jackpot-winning outcomes in some embodiments and, as a result, a corresponding progressive jackpot amount is awarded. The corresponding progressive jackpot in FIG. 6 is $10.43, as displayed by the highlighted progressive jackpot indicator 72*a*.

In accordance with embodiments of the invention, a video image may be overlaid on the reels 54*a-e* (or the visible portions thereof) to enhance the entertainment value of the progressive game. The video image may be a direct image or a virtual image, and it may be generated using the video overlay technology described above (see FIGS. 2*a*-2*b*) or some other suitable video overlay technology known to those having ordinary skill in the art. Such a video image overlay makes possible a significant number of enhancements for the wagering game.

In one embodiment, the enhancements may involve the overlaid video image providing one or more colored portions that can be precisely positioned over selected reel symbol positions. The colored portions may be translucent so that the underlying reel symbols are clearly discernible to players through the video image, or they may be opaque to either partially or completely mask the underlying reel symbols. Each colored portion typically has a size and shape that is sufficient to substantially cover only one reel symbol position. These colored portions may then be positioned in the video image to superimpose a predetermined color on selected reel symbol positions in order to hold the reel symbol positions. Such a predetermined color may then be maintained over the reel symbol positions across multiple spins or plays of the wagering game.

The above arrangement is particularly useful when the outcome of the wagering game results in only a partial pattern being formed (i.e., no progressive jackpot is awarded) by the reel symbols 70 having the colored background. When such an outcome occurs, the overlaid video image may be used to help players fill in the partial pattern and win one of the progressive jackpots. For example, in one embodiment, the colored portions of the overlaid video image may be positioned so as to superimpose a pattern identical to the partial pattern over the reels 54*a-e*. The superimposed pattern of colored portions in the video image may then be used as a sort of placeholder for the partial pattern, allowing the reels 54*a-e* to spin again without losing the partial pattern. Players may then re-spin the reels 54*a-e* one or more times in hopes that reel symbols 70 having the colored background will stop on whichever reel symbol positions are needed to complete the partial pattern. Preferably, the color of the colored portions is the same as the color of the background of the reel symbols 70 to more closely resemble the reel symbols 70.

Figure 7A:
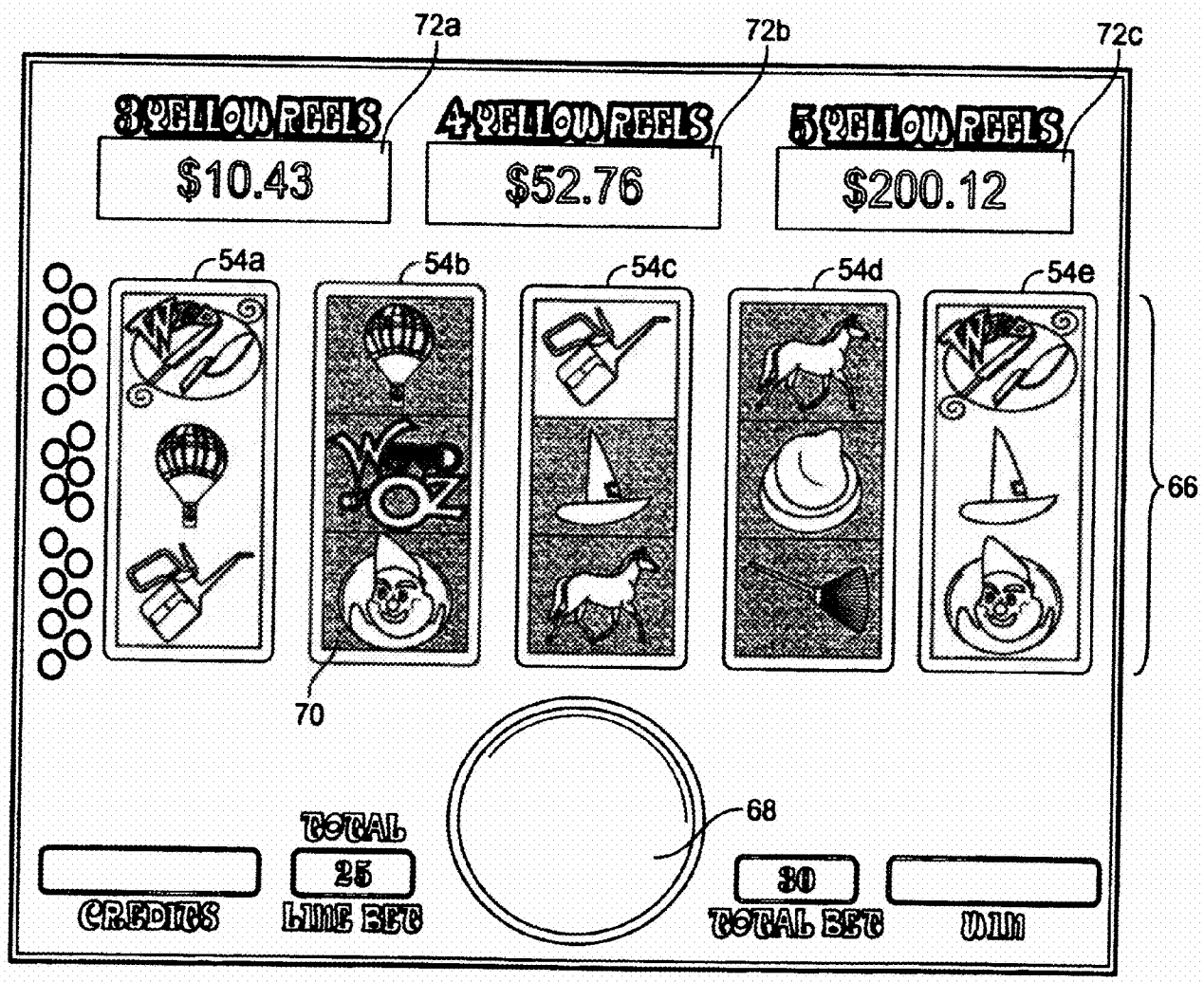
Figure 7B:
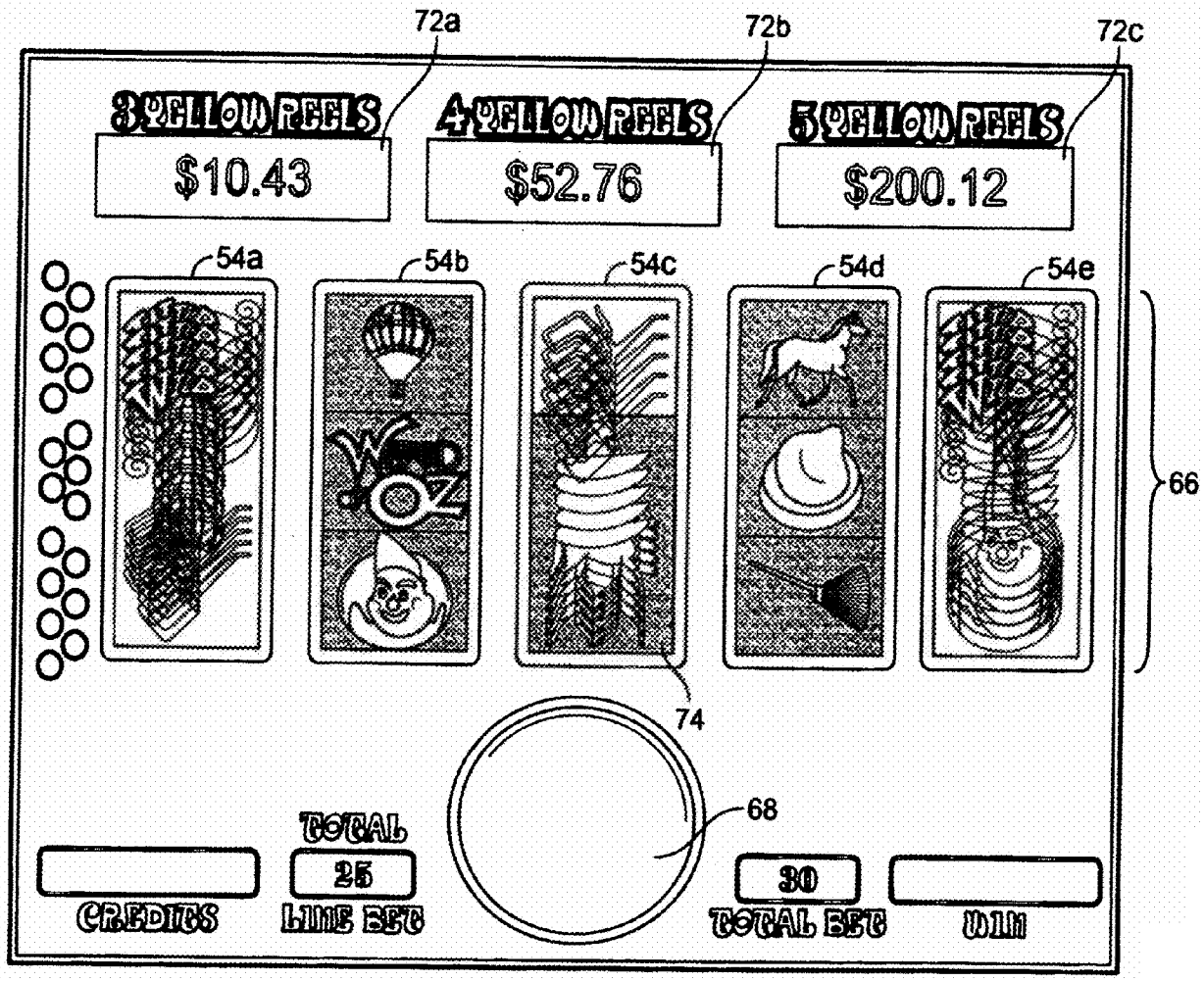

FIGS. 7*a*-7*b* illustrate an embodiment of the invention involving the re-spin of the reels 54*a-e*. As can be seen in FIG. 7*a*, all of the reel symbol positions of the second reel 54*b* and fourth reel 54*d*, as well as the middle and bottom reel symbol positions of the third reel 54*c*, are occupied by reel symbols 70 having the colored background. Unfortunately, this particular positioning of reel symbols 70 only partially forms one of the predefined patterns that constitute a progressive jackpot-winning outcome. Thus, in accordance with embodiments of the invention, players may be allowed to re-spin the reels 54*a-e* to try and complete the partial pattern. During the re-spin, the colored portions of the overlaid video image may be used as a placeholder to "hold" the partial pattern in place over the reels 54*a-e*. This is illustrated in FIG. 7*b*, where the colored portions 74 of the overlaid video image can be seen "holding" the partial pattern in place as one or more of the reels 54*a-e* are being re-spun.

In some embodiments, reels 54*a-e* in which all of the reel symbol positions are already occupied by reel symbols 70 having the colored background are not re-spun, as there is usually no benefit in doing so. This can be seen in FIG. 7*b*, where the second reel 54*b* and fourth reel 54*d* are not re-spun because all of the reel symbol positions in these two reels are already occupied by reel symbols 70 having the colored background. Alternatively, the overlaid video image can hold the partial pattern in place where all of the plurality of reels 54*a-e* are subsequently spun.

The re-spin of the reels 54*a-e* may be provided as a random award, for example, to compensate players who have failed to achieve a winning outcome in the wagering game. Alternatively, the re-spin of the reels 54*a-e* may be triggered by a certain designated reel symbol or combination of designated reel symbols appearing in the outcome of the wagering game. In one embodiment, for example, a re-spin may be awarded if the outcome, although not a winning outcome, contains at least two reels 54*a-e* that are completely filled with reel symbols 70 having the colored background. Such an arrangement serves to encourage players who may otherwise become discouraged by their failure to achieve a winning outcome. In yet another embodiment, players may be allowed to purchase a re-spin of the reels 54*a-e*, for example, by placing an extra wager. Such an extra wager may be made at any time in some embodiments, or it may be available only when a designated symbol or combination of symbols appear in the outcome of the wagering game.

Figure 8:
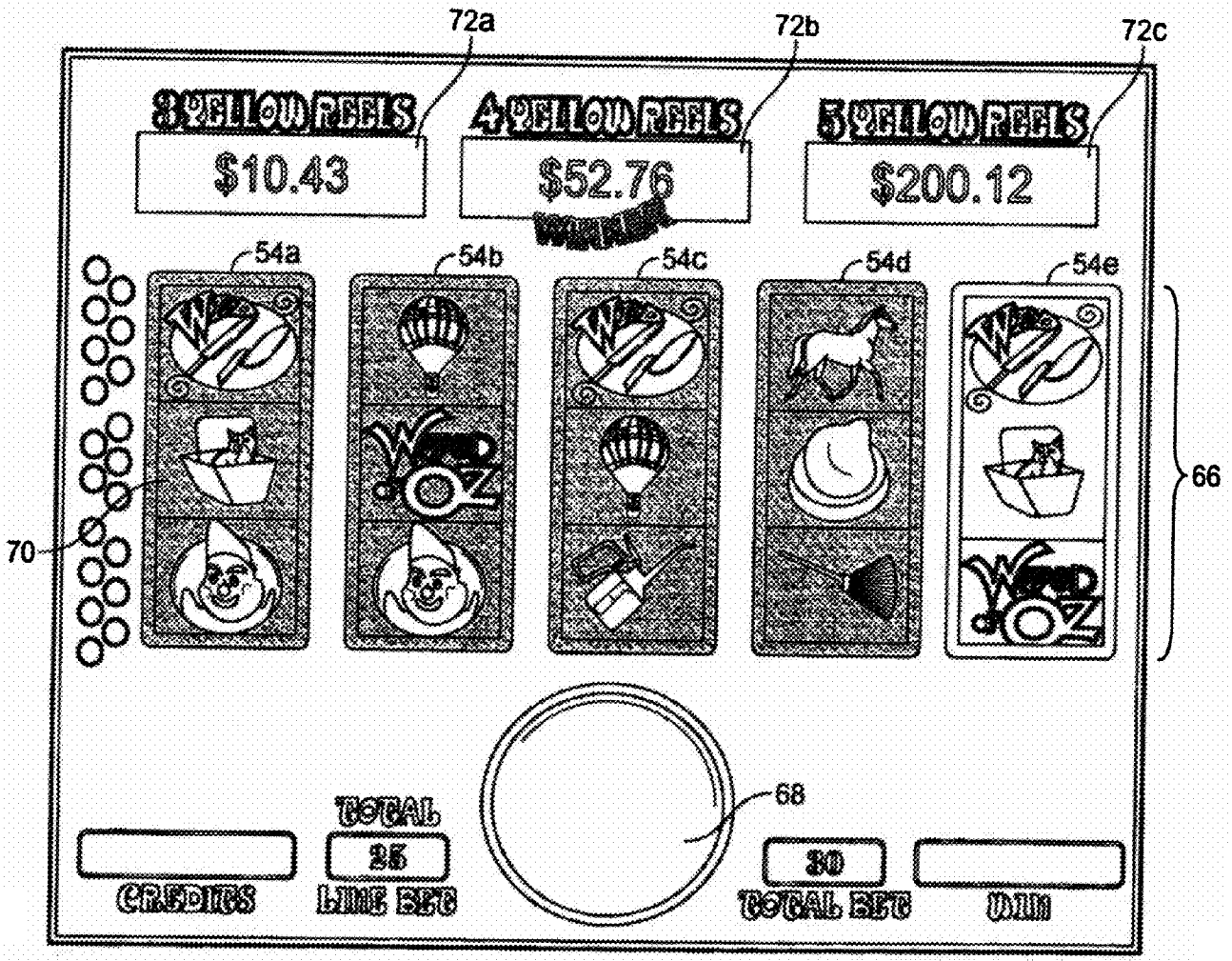

FIG. 8 illustrates one possible outcome of the re-spin shown in FIG. 7*b*. As can be seen, in this embodiment, the re-spin has added enough reel symbols 70 having the colored background to completely fill in all of the first four reels 54*a-d*. These four reels 54*a-d* constitute one of the progressive jackpot-winning outcomes and, as a result, the player is awarded a corresponding progressive jackpot. The corresponding progressive jackpot in this example is $52.76, as indicated by the progressive jackpot indicator 72*b*.

Note that while a single color has been used in the foregoing embodiments, multiple colors may also be used without departing from the scope of the invention. For example, instead of having a single background color for the reel symbols 70, multiple background colors may be used for the reel symbols 70. Alternatively, instead of only the reel symbols 70 having a colored background, every reel symbol 66 may have a colored background, but with different colors for the background. Progressive jackpots may then be awarded based on one or more predefined patterns formed by the particular background color or colors that appear in the outcome of the wagering game. For example, patterns formed with reel symbols having a yellow background may result in one level of progressive jackpots, whereas patterns formed with reel symbols having a red background (or no background color) may result in a higher level of progressive jackpots, and so forth.

In some embodiments, instead of (or in addition to) a colored background, a different type of indicia may be used. For example, the indicia may be one that is dynamic and changing instead a static indicia. Furthermore, the indicia may provide a useful function, such as displaying various information about the wagering game. These dynamic indicia may be in the form of a small field on the face of selected reel symbols that displays, for example, up-to-date information on the progressive jackpot amount. The reel symbols having the dynamic indicia may be chosen randomly, or they may be chosen according to a predetermined scheme similar to the scheme used to choose the reel symbols 70 having the colored background (see FIGS. 5-8). And like the colored background, the dynamic indicia may be implemented using either video reels or mechanical reels without departing from the scope of the invention. For mechanical reels, the dynamic indicia may be a small LCD or other suitable display located within selected ones of the reel symbols.

Figure 9:
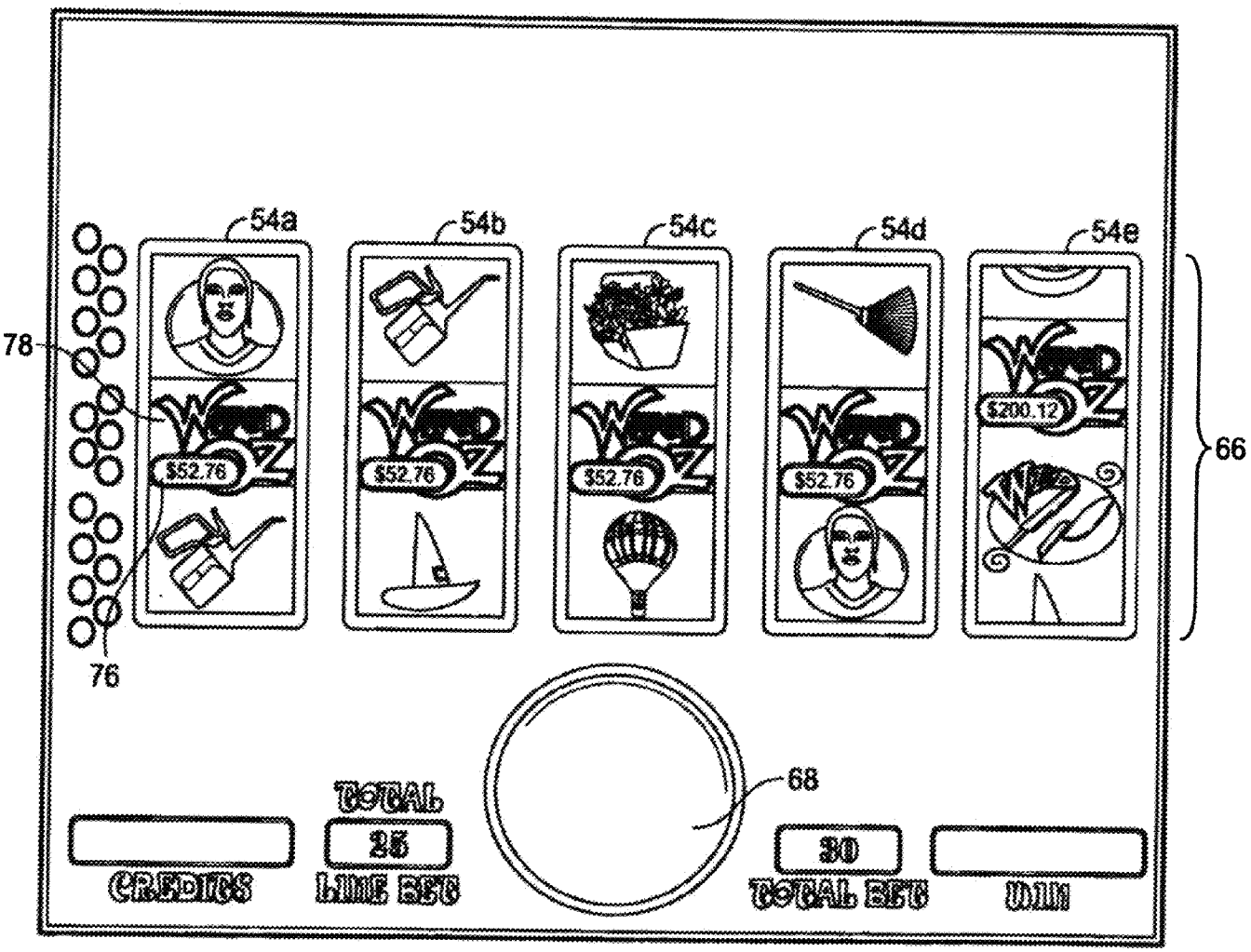
FIG. 9 illustrates another exemplary wagering game embodying the present invention.

FIG. 9 illustrates an example of a dynamic indicium in the form of a small field 76 within selected ones of the reel symbols 66. The fields 76 in this example are progressive-jackpot fields insofar as they display the current value of the progressive jackpots associated with the wagering game. In this regard, the progressive-jackpot fields 76 are similar to the progressive-jackpot indicators 72*a-c* shown in FIGS. 5-8. Preferably, the particular reel symbols 66 containing the progressive-jackpot fields 76 are progressive-game symbols 78 that trigger a progressive jackpot when they appear in a predefined pattern (e.g., a payline). These progressive-game symbols 78 may additionally contain one or more progressive-game icons or images, in some embodiments, that further identify them as progressive-game symbols 78. The size of each progressive-jackpot field 76 is preferably large enough so that the information in the field is clearly discernible to players, but not so large as to obscure the icon or image of the progressive-game symbol 78.

In operation, when one of the progressive-game symbols 78 lands in a predefined pattern, the progressive-jackpot field 76 for that symbol 78 displays the current progressive-jackpot amount associated with that pattern. Thus, if three progressive-jackpot symbols 78 land in a predefined pattern, the progressive-jackpot fields 76 within the three progressive-jackpot symbols 78 display the amount for the corresponding-progressive jackpot. On the other hand, if four progressive-jackpot symbols 78 land in the predefined pattern, the current amount for the progressive jackpot corresponding to the four symbols 78 is displayed, and so forth.

It is also possible to display the current amount of the progressive jackpot in the progressive-jackpot fields 76 before the reels 54*a-e* come to a stop, for example, as the reels 54*a-e* are slowing down. In FIG. 9, for example, the progressive-jackpot symbols 78 in the first four reels 54*a-d* have landed in a predefined pattern (e.g., a payline), resulting in a progressive jackpot of $52.76 being awarded. The progressive-jackpot fields 76 within these progressive-jackpot symbols 78 accordingly display a value of $52.76. One of the progressive-jackpot symbols 78 in the fifth reel 54*e* is about to land in the predefined pattern, which would result in a different progressive jackpot having a value of $200.12 being awarded. As such, the progressive-jackpot field 76 within that progressive-jackpot symbol 78 displays the higher jackpot value of $200.12, and does so before the fifth reel 54*e* has come to a stop. When this progressive-jackpot symbol 78 finally lands, the progressive-jackpot fields 76 of the first four reels 54*a-d* change over to the new progressive-jackpot value $200.12.

Each of these embodiments and obvious variations thereof is contemplated as falling within the spirit and scope of the claimed invention, which is set forth in the following claims.

The invention claimed is:

1. A gaming machine configured to conduct a wagering game, the gaming machine comprising:

at least one input device for receiving a wager from a player to initiate said wagering game;

one or more display devices for displaying images related to play of said wagering game;

one or more processors; and at least one memory device storing instructions that, when executed by said one or more processors, cause said gaming machine to:

display an outcome of said wagering game, said outcome being randomly selected from a plurality of outcomes, said plurality of outcomes being represented by a plurality of game symbols having one of a first color background and a second color background, said first and second colors being different colors;

award a symbol award to said player in response to one or more of said game symbols forming a predefined symbol pattern in said outcome; and award a special event to said player in response to one or more first color backgrounds of game symbols in said outcome forming a predefined special event pattern.

2. The gaming machine according to claim 1, wherein said one or more display devices include a video display device, and said plurality of game symbols are displayed on said video display device.

3. The gaming machine according to claim 1, wherein said one or more display devices include a mechanical display device and said plurality of game symbols are displayed on said mechanical display device.

4. The gaming machine according to claim 3, wherein said one or more display devices further include a video overlay device operable to overlay a video image over said mechanical display device, said video image including colored portions that mark a position of said one or more first color backgrounds displayed on said mechanical display device, wherein the colored portions are maintained for multiple plays of said wagering game.

5. The gaming machine according to claim 1, wherein said special event comprises a progressive jackpot.

6. The gaming machine according to claim 5, wherein said progressive jackpot is one of several progressive jackpots, each progressive jackpot being triggered by a different predefined pattern of first color backgrounds of gaming symbols displayed in said outcome.

7. The gaming machine according to claim 1, wherein said predefined pattern includes one or more of a predetermined payline filled with game symbols having said first color backgrounds and a two-dimensional array filled with game symbols having said first color backgrounds.

8. The gaming machine according to claim 1, wherein said awarding of said special event comprises initiating one or more of a bonus game, a community game, and a secondary game.

9. A computer-implemented method of conducting a wagering game on a gaming machine, comprising:

receiving, via at least one input device, a wager from a player to initiate said wagering game;

displaying, via one or more display devices, a first outcome of said wagering game, said first outcome being randomly selected from a plurality of outcomes, said plurality of outcomes being represented by a plurality of game symbols having one of a first color background and a second color background, said first and second colors being different colors;

overlaying a video image on said displayed first outcome, said video image including colored placeholders positioned over said game symbols having said first color background appearing in said first outcome;

awarding a symbol award to said player in response to one or more of said game symbols forming a predetermined symbol pattern in said first outcome;

randomly selecting, via the one or more processors, a second outcome of said plurality of outcomes;

displaying, on said one or more display devices, said second outcome while maintaining said overlaying video image of said colored placeholders; and awarding a special event to said player in response to said second outcome including a predefined special event pattern defined by said colored placeholders in combination with one or more first color backgrounds of game symbols appearing in said second outcome.

10. The method according to claim 9, wherein said special event includes a progressive jackpot.

11. The method according to claim 9, wherein said one or more display devices comprise a plurality of reels, and said plurality of game symbols are reel symbols on said reels.

12. The method according to claim 11, wherein each reel includes at least one sequence of three or more consecutive reel symbols having said first color background.

13. The method according to claim 11, wherein said special event pattern comprises one or more of reel symbols having said first color background filling at least three reels, reel symbols having said first color background filling at least three adjacent reels, and reel symbols having said first color background filling at least one payline.

14. The method according to claim 11, wherein said plurality of reels are mechanical reels, and said overlaying of said video image is performed using a video overlay device.

15. The method according to claim 9, wherein said one or more display devices includes a video display device, said game symbols being displayed by said video display device, said video display device further displaying said colored placeholders overlaying said game symbols having said first color background.

16. The method according to claim 9, further comprising randomly selecting said second outcome of said wagering game upon receiving an additional wager from the player.

17. A computer-implemented method of conducting a wagering game on a gaming system, the method comprising:

receiving, via at least one input device, a wager from a player to initiate said wagering game;

displaying, via one or more display devices, an outcome of said wagering game, said outcome being randomly selected from a plurality of outcomes, said plurality of outcomes being represented by a plurality of game symbols having one of a first color background and a second color background, said first and second colors being different colors;

awarding a symbol award to said player in response to one or more of said game symbols in said first outcome forming a predefined symbol pattern; and awarding a special event to said player in response to one or more first color backgrounds of game symbols in said first outcome forming a predefined special event pattern.

18. The method of claim 17, wherein said one or more display devices further include a video overlay device operable to overlay a video image over said mechanical display device, said video image including colored portions that mark a position of said one or more game symbols having said first color backgrounds displayed on said mechanical display device, wherein the colored portions are maintained over multiple plays of said wagering game.

19. The method of claim 17, wherein said one or more display devices comprise a plurality of reels and said plurality of game symbols are reel symbols on said reels.

20. The method of claim 19, wherein each reel includes at least one sequence of three or more consecutive reel symbols having said first color background.

21. The method of claim 19, wherein said special event pattern comprises one or more of reel symbols having said first color background filling at least three reels, reel symbols having said first color background filling at least three adjacent reels, and reel symbols having said first color background filling at least one payline.

22. The method of claim 17, wherein said plurality of game symbols have one of a first color background, a second color background, and a third color background, said first, second, and third colors being different colors, wherein said special event includes a first, second, and third progressive jackpot associated with the first, second, and third colors, respectively, and wherein awarding said special event includes awarding said first progressive jackpot in response to one or more first color backgrounds forming a first predefined pattern, awarding said second progressive jackpot in response to one or more second color backgrounds forming a second predefined pattern, and awarding said third progressive jackpot in response to one or more third color backgrounds forming a third predefined pattern.

23. The method of claim 22, wherein said first, second, and third predefined patterns are the same patterns of each colored background.

24. The method of claim 22, wherein said first, second, and third predefined patterns are different patterns of each colored background.

25. A machine-readable, non-transitory medium including executable instructions that, when executed by a gaming system, cause said gaming system to perform a method comprising:

receiving, via at least one input device, a wager from a player to initiate said wagering game;

displaying, via one or more display devices, an outcome of said wagering game, said outcome being randomly selected from a plurality of outcomes, said plurality of outcomes being represented by a plurality of game symbols having one of a first color background and a second color background, said first and second colors being different colors;

awarding a symbol award to said player in response to one or more of said game symbols in said outcome forming a predefined symbol pattern; and awarding a special event to said player in response to one or more first color background of game symbols in said outcome forming a predefined special event pattern.

* * * * *